US006483410B2

(12) United States Patent
Bernardi et al.

(10) Patent No.: US 6,483,410 B2
(45) Date of Patent: Nov. 19, 2002

(54) IGNITION COIL FOR MOTOR VEHICLES

(75) Inventors: Giorgio Bernardi, Carpi (IT); Graziano Gualdi, Carpi (IT); Roberto Righi, Carpi (IT)

(73) Assignee: Federal-Mogul Ignition-Srl, Milan (IT)

( * ) Notice: Subject to any disclaimer, the term of this patent is extended or adjusted under 35 U.S.C. 154(b) by 0 days.

(21) Appl. No.: 09/872,324

(22) Filed: Jun. 1, 2001

(65) Prior Publication Data

US 2001/0052836 A1 Dec. 20, 2001

(30) Foreign Application Priority Data

Jun. 6, 2000 (EP) ..... 00830406

(51) Int. Cl.[7] ..... H01F 27/02
(52) U.S. Cl. ..... 336/90; 336/96; 336/90
(58) Field of Search ..... 336/96, 90, 92; 123/634, 635

(56) References Cited

U.S. PATENT DOCUMENTS

| | | | | |
|---|---|---|---|---|
| 5,590,637 A | | 1/1997 | Motodate | 123/634 |
| 6,169,471 B1 | * | 1/2001 | Sakamaki et al. | 336/96 |
| 6,188,304 B1 | * | 2/2001 | Skinner et al. | 336/107 |
| 6,215,385 B1 | * | 4/2001 | Ogden | 336/96 |

FOREIGN PATENT DOCUMENTS

| | | |
|---|---|---|
| DE | 198 60 043 A | 7/1999 |
| EP | 0 387 993 A | 9/1990 |
| EP | 0 791 732 A | 8/1997 |
| FR | 2 624 559 A | 6/1989 |

OTHER PUBLICATIONS

Shimoide et al. [US 2002/0011910], Jan. 2002.*

* cited by examiner

*Primary Examiner*—Anh Mai
(74) *Attorney, Agent, or Firm*—Reising, Ethington, Barnes, Kisselle, Learman & McCulooch, P.C.

(57) ABSTRACT

An ignition coil for motor vehicles, comprising: a magnetic core (12) having a rectilinear axis; a secondary spool (16) supporting a high-voltage winding (18) and being set coaxially with respect to the magnetic core (12); a primary spool (20) supporting a low-voltage winding (22) and being set coaxially with respect to the secondary spool (16) and outside the latter; a tubular-shaped outer casing (24) which encloses the assembly comprising the magnetic core (12) and the spools (16, 20); and a low-voltage connector (28) including a connector body (30) made of plastic material and a plurality of metal contacts (32) fixed to the connector body (30). In the ignition coil, the connector body (30) is made of a single piece with the primary spool (20).

5 Claims, 2 Drawing Sheets

IGNITION COIL FOR MOTOR VEHICLES

BACKGROUND OF THE INVENTION

The present invention relates to an ignition coil for motor vehicles, as specified in the preamble of claim 1.

The invention relates to an ignition coil which, in use, is designed to be mounted directly on a corresponding spark plug. A known ignition coil of this type has an elongated shape and comprises a magnetic core which has a rectilinear axis and is housed inside a secondary spool which carries a high-voltage winding. The secondary spool is in turn set inside a primary spool which carries a low-voltage winding. The assembly comprising the magnetic core and the two spools with their respective windings is housed in a tubular casing filled with an insulating resin. The ignition coil comprises a low-voltage connector including a body made of plastic material, and pin-shaped metal contacts which are electrically connected to the low-voltage winding.

SUMMARY OF THE INVENTION

The object of the present invention is to improve on an ignition coil of the type specified above in such a way as to enable reduction in the number of components, as well as in the production and assembly costs of the above-mentioned coil.

According to the present invention, the aforesaid object is achieved by an ignition coil having the characteristics specified in claim 1.

BRIEF DESCRIPTION OF THE DRAWINGS

The present invention will now be described in detail with reference to the attached drawings, which are provided purely to furnish a non-limiting example, and in which.

DETAILED DESCRIPTION OF THE PREFERRED EMBODIMENT

Figure 1:
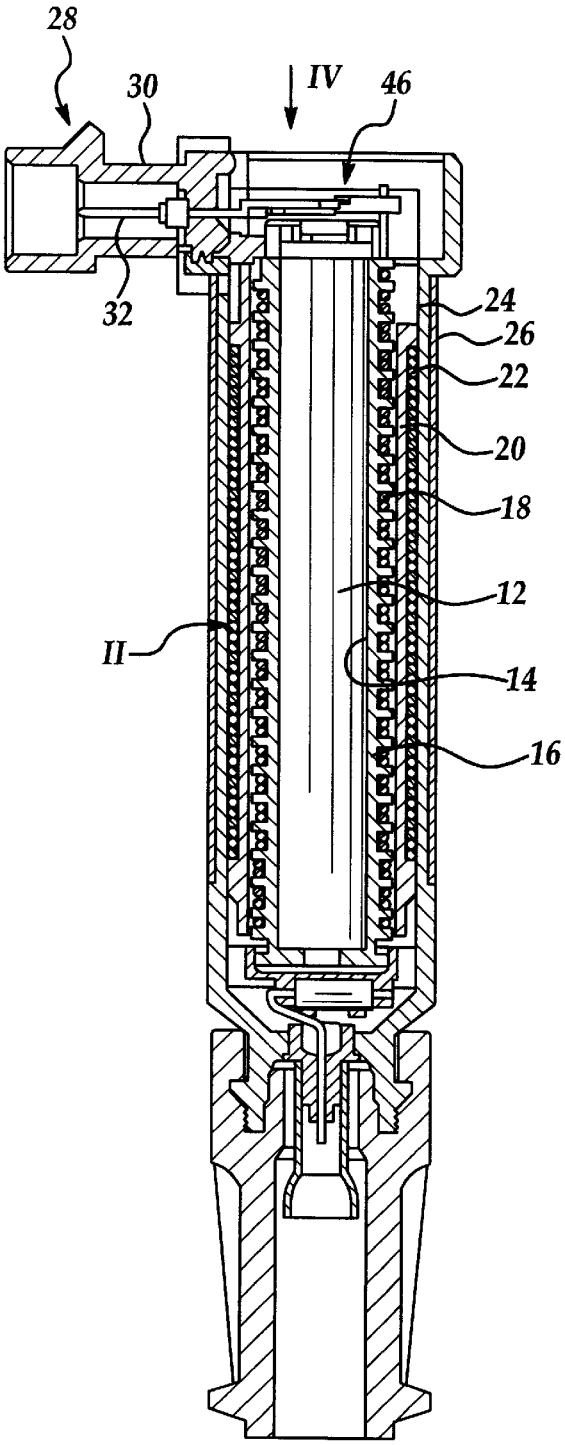
FIG. 1 is an axial sectional view of an ignition coil according to the present invention.
Figure 2:
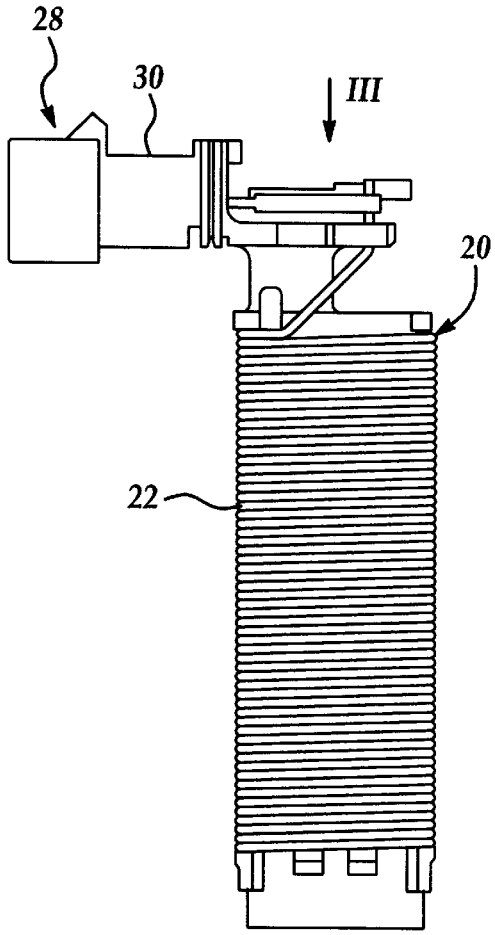
FIG. 2 is an elevation of the spool supporting the low-voltage winding.

With reference to the drawings, the number 10 designates an ignition coil for motor vehicles, which is designed to be used on internal-combustion engines with spark ignition. The coil 10 comprises a magnetic core 12 having a rectilinear axis which consists, in a way in itself known, of a stack of metal laminations made of a material with high magnetic permeability. The laminated magnetic core 12 is housed inside a cylindrical cavity 14 of a first spool 16 made of plastic material, on which a high-voltage winding 18 is wound. The first spool 16 is in turn inserted inside a second spool 20 made of injection-moulded plastic material on which a low-voltage winding 22 is wound. The assembly consisting of the magnetic core 12 and of the spools 16 and 20 is inserted in an outer tubular casing 24, on the external surface of which are wrapped one or more metal sheets in such a way as to form a sheath that encloses the magnetic circuit. After assembly of the various components, the casing 24 is filled with a dielectric resin, for example of the epoxy type, which forms an insulator between the various components of the ignition coil.

In the sequel of the description and in the claims, the spool on which the low-voltage winding is wound (primary winding) will be referred to as "primary spool", and the spool on which the high-voltage winding is wound (secondary winding) will be referred to as the "secondary spool".

The ignition coil 10 comprises a low-voltage connector 28 which includes a connector body 30 made of a single piece with the primary spool 20. The connector body 30 carries a plurality of pin-shaped contacts 32 which can be inserted in respective holes provided in the connector body 30, or else they can be co-moulded together with the primary coil and the connector body 30.

Figure 3:
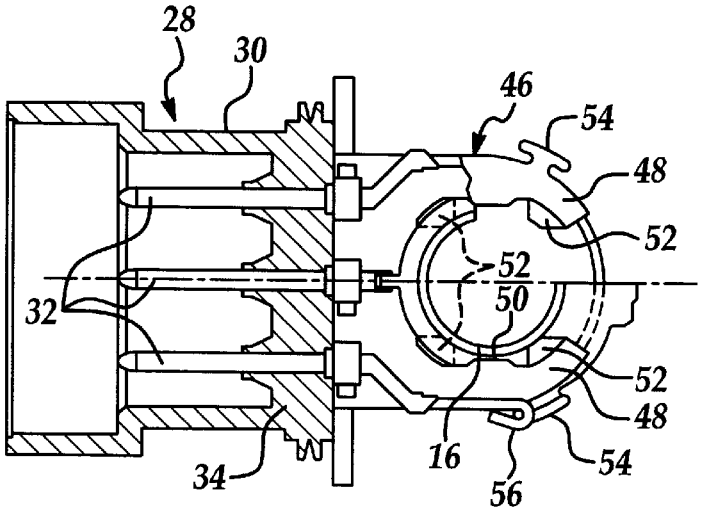
FIGS. 3 and 4 are plan views, partially sectioned, respectively according to the arrows III and IV, of FIGS. 1 and 2.

With reference to FIG. 3, the two contacts 32 in the outer position are electrically connected to respective end portions of the low-voltage winding 22, whilst the contact set in the central position is connected to ground.

The fact of integrating the low-voltage connector 28 with the low-voltage spool 20 enables an improvement in the efficiency of the production process for manufacturing the ignition coil and enables elimination of assembly operations, and consequent reduction in costs of the product.

Figure 4:
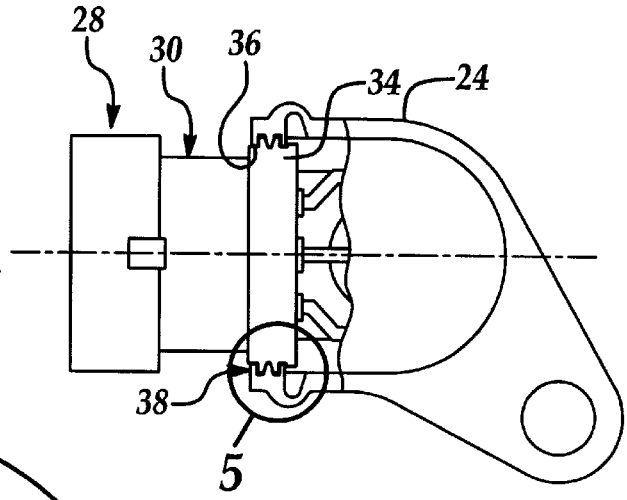
Figure 5:
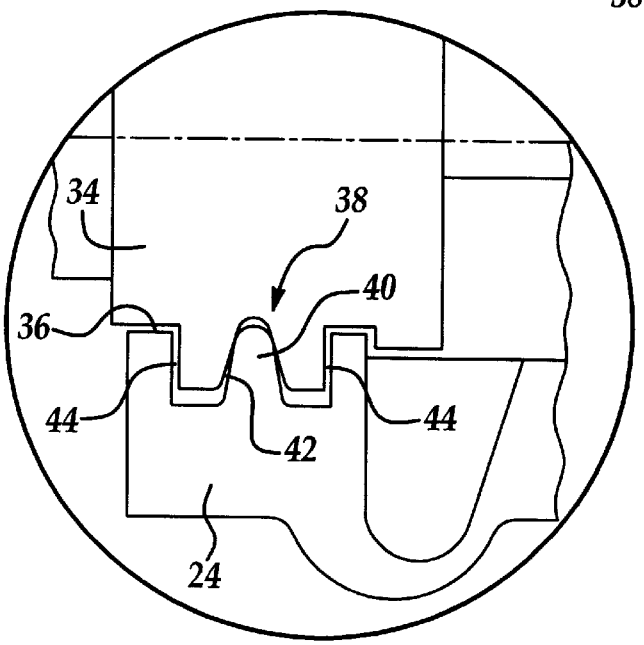
FIG. 5 is a detail, at an enlarged scale, of the part circled in FIG. 4.

With reference to FIGS. 3–5, the connector body 30 has a base portion 34 provided with holes in which the aforesaid metal contacts 32 are inserted. The base portion 34 has a rectangular cross section and fits in a seat 36 provided in the casing 24. The seat 36 is open at the top so that the base portion 34 of the connector body 30 can be inserted in the seat 36 with a movement from the top downwards (see FIG. 1), in a direction parallel to the longitudinal axis of the ignition coil. The base portion 34 co-operates with the seat 36 along three sides, whilst the top side (i.e., the one facing the outside of the ignition coil) is free. According to a preferred embodiment of the invention, the area of contact between the base portion 34 of the connector body 30 and the seat 36 of the casing 24 makes a labyrinth seal 38. As may be seen in greater detail in FIG. 5, the labyrinth seal comprises at least one coupling between a ribbing 40 and a groove 42, which mate together along respective sides. In cross section, the ribbing 40 and the groove 42 have tapered sides, but with a different angle of inclination so that the ribbing 40 establishes an interference contact on the sides of the of the groove 42. This interference creates a seal contact that prevents the epoxy resin that fills the casing 24 from coming out. Preferably, on both sides of the connection between the ribbing 40 and the groove 42, the facing surfaces of the base portion 34 and of the seat 36 form a path 44 with restricted section which contributes to increasing the seal that prevents the resin from coming out.

The integral portion making up the connector body 30 further comprises a centring element 46 which co-operates with the secondary spool 16. The centring element 46 is also made of a single piece with the primary spool 20 and comprises a pair of arms 48 which between them define a substantially circular seat 50 that is partially open. An end portion of the secondary spool 16, which protrudes axially beyond the top edge of the primary spool 20, is snap-inserted into the seat 50 and is kept in a pre-set position with respect to the primary spool 20 by a series of centring protrusions 52 (see FIG. 3).

As may be seen in FIGS. 1 and 3, the centring element 46 makes it possible to maintain a pre-set and constant distance between the internal surface of the primary spool 20 and the external surface of the secondary spool 16, so that the space in a radial direction between the two spools can be filled with a uniform thickness of resin.

With reference to FIG. 3, on the outer surfaces of the arms 48 of the centring device 46 two mushroom-shaped anchoring portions 54 are preferably formed. Each end stretch of the primary winding is wound on a respective anchoring portion 54 and is then crimped and soldered to a respective connecting portion 56 of a contact 32. The winding of the ends of the electrical conductors about the anchoring portions 54 has the purpose of reducing the tension on the end portions of the conductors in the stretch between each anchoring portion 54 and the corresponding end of the contact 32.

What is claimed is:

1. An ignition coil for motor vehicles, comprising:

a magnetic core (12) having a rectilinear axis;

a secondary spool (16) supporting a high-voltage winding (18) and being set coaxially with respect to the magnetic core (12);

a primary spool (20) supporting a low-voltage winding (22) and being set coaxially with respect to the secondary spool (16) and outside the latter;

a tubular-spaced outer casing (24) which encloses the assembly comprising the magnetic core (12) and the spools (16, 20); and a low-voltage connector (28) including a connector body (30) made of plastic material and a plurality of metal contacts (32) fixed to the connector body (30), characterized in that the aforesaid connector body (30) is made of a single piece with the primary spool (20).

2. An ignition coil as per claim 1, characterized in that the aforesaid connector body (30) co-operates with the casing (24) by means of a labyrinth-seal area (38) including a coupling between a ribbing (40) and a groove (42) which co-operate together along respective sides.

3. An ignition coil as per claim 1, characterized in that the aforesaid connector body (30) has an integral centring element (46) provided with a seat (50) inside which is housed an end portion of the secondary spool (16), said end portion protruding axially beyond a corresponding end of the primary spool (20).

4. An ignition coil as per claim 3, characterized in that the aforesaid centring element (46) comprises a pair of arms (48) defining between each other a seat (50) which is partially open and is provided with centring projections (52) co-operating with the aforesaid end portion of the secondary spool (16).

5. An ignition coil as per claim 4, characterized in that the aforesaid arms (48) are provided with respective anchoring portions (54), on each of which is wound an end portion of the conductor forming the low-voltage winding (22), in such a way as to obtain a stretch of conductor without tension between each anchoring portion (54) and a respective connection portion (56) of a contact (32).

* * * * *

UNITED STATES PATENT AND TRADEMARK OFFICE

CERTIFICATE OF CORRECTION

PATENT NO. : 6,483,410 B2
DATED : November 19, 2002
INVENTOR(S) : Giorgio Bernardi et al.

It is certified that error appears in the above-identified patent and that said Letters Patent is hereby corrected as shown below:

Column 3,
Line 24, delete “tubular-spaced” and insert therefor -- tubular-shaped --.

Signed and Sealed this

Fourth Day of March, 2003

JAMES E. ROGAN
*Director of the United States Patent and Trademark Office*